United States Patent [19]

Sato et al.

[11] 4,194,460

[45] Mar. 25, 1980

[54] VIBRATION ABSORBED ENGINE EXHAUST MEANS FOR MOTOR PROPELLED BOATS

[75] Inventors: Masato Sato, Akashi; Takemi Inoue, Kakogawa, both of Japan

[73] Assignee: Kawasaki Jukogyo Kabushiki Kaisha, Ikuta, Japan

[21] Appl. No.: 866,911

[22] Filed: Jan. 4, 1978

[30] Foreign Application Priority Data

Jan. 13, 1977 [JP] Japan ..... 52-3601[U]

[51] Int. Cl.[2] ..... B63H 21/32

[52] U.S. Cl. ..... 115/73; 115/70; 115/75; 285/41; 285/236

[58] Field of Search ..... 248/18, 60, 610; 285/236, 41; 115/73, 75, 70, 34 R

[56] References Cited

U.S. PATENT DOCUMENTS

| | | | |
|---|---|---|---|
| 1,900,561 | 3/1933 | Junggren | 285/236 X |
| 2,261,948 | 11/1941 | Beach | 285/236 X |
| 2,935,039 | 5/1960 | Thompson | 115/73 |
| 3,270,992 | 9/1966 | Cassel | 248/18 X |
| 3,752,111 | 8/1973 | Meynier, Jr. | 115/34 R |
| 3,834,341 | 9/1974 | Sexton et al. | 115/75 |

*Primary Examiner*—Sherman D. Basinger
*Attorney, Agent, or Firm*—Dennis P. Clarke

[57] ABSTRACT

A motor-propelled boat comprising a boat hull, an internal combustion engine mounted on the boat hull through a resilient mounting and adpated to drive a propulsion unit, the engine including a body and exhaust unit connected with the body, the exhaust including a first pipe rigidly connected with the body and a second pipe connected with the first pipe through a resilient connecting unit, the second pipe being further supported through a resilient support by the body of the engine.

7 Claims, 4 Drawing Figures

VIBRATION ABSORBED ENGINE EXHAUST MEANS FOR MOTOR PROPELLED BOATS

The present invention relates to motor-propelled boats and more particularly to engine exhaust means for such boats. More specifically, the present invention pertains to vibration absorbing arrangements in engine exhaust means for motor-propelled boats.

Conventionally, it has been a common practice in motor-propelled boats to mount engines on boat hulls through resilient mounting means so that engine vibrations are absorbed by the mounting means before they are transmitted to the boat hulls. However, since the engine exhaust systems are rigid with respect both to the engines and to the boat hulls, the engine vibrations are transmitted through the exhaust systems to the boat hulls. This fact causes unconfortable vibrations of boat hulls and additionally applies substantial vibration loads to parts in the exhaust systems.

It is therefore an object of the present invention to provide engine exhaust means for motor-propelled boats wherein means is provided for isolating transmittal of engine vibration to the boat hull.

Another object of the present invention is to provide vibration absorbing arrangements for engine exhaust means in motor-propelled boats.

Still further object of the present invention is to provide means for preventing vibration loads from being transmitted to parts in the engine exhaust system.

A further object of the present invention is to provide means for protecting vibration absorbing members in engine exhaust means.

According to the present invention, the above and other objects can be accomplished by a motor-propelled boat comprising a boat hull, internal combustion engine means mounted on said boat hull through resilient mounting means and adapted to drive propulsion means, said engine means including body means and exhaust means connected with said body means, said exhaust means including first pipe means rigidly connected with the body means and second pipe means connected with the first pipe means through resilient connecting means, said second pipe means being further supported through resilient support means by said body means of the engine means. According to a preferable aspect of the present invention, said first and second pipe means are provided with first and second sheath means respectively rigid with said first and second pipe means at ends where the pipe means are butted against each other, said resilient connecting means including resilient tubular member means adapted to be fitted to the first and second sheath means to connect the first and second pipe means together. Clamp means may preferably be provided for tightly securing the resilient tubular member means both to the first and second sheath means.

Preferably, the sheath means should be provided on the respective pipe means with an annular clearance therebetween so that a thermally insulative air gap is provided substantially along the length of the sheath means. This arrangement has been found advantageous in preventing or decreasing heat transfer from the pipe means to be resilient connecting means. The sheath means may conveniently be formed separately from the associated pipe means and secured thereto by any suitable means such as welding. However, the sheath means may of course be formed integrally with the pipe means.

The above and other objects and features of the present invention will become apparent from the following descriptions of preferred embodiments taking reference to the accompanying drawings, in which.

Figure 1:
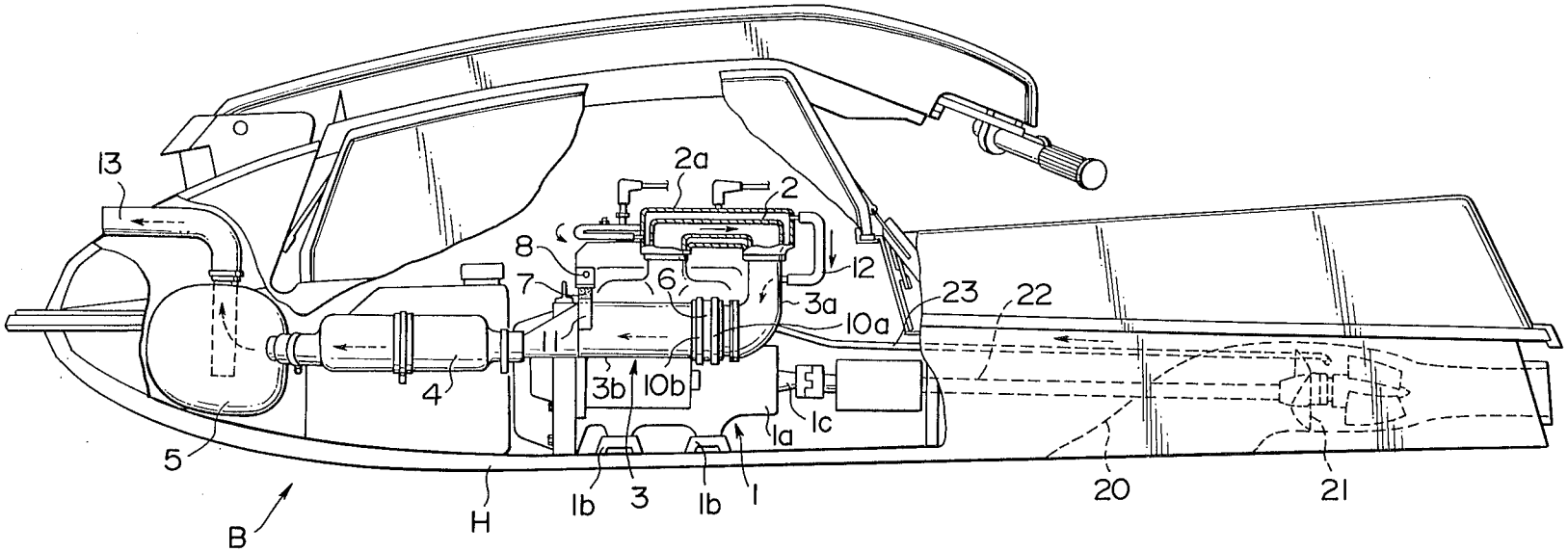
FIG. 1 is a partially cut-away side view of a boat embodying the features of the present invention.

Referring to the drawings, particularly to FIG. 1, there is shown a water-jet boat B having a boat hull H. In the boat hull H, there is mounted an internal combustion engine 1 having a body 1*a*. As conventional in the art, the engine body 1*a* is mounted on the hull H through resilient engine mounts 1*b* so that the engine vibration is absorbed before it is transmitted to the boat hull H. The boat hull H is formed at the rear portion thereof with a water passage 20 which opens at the front end to the bottom of the hull H and at the rear end to the stern. In the water passage 20, there is disposed a water jet propulsion unit 21 which is drivingly connected through a shaft 22 with the output shaft 1*c* of the engine 1.

The engine 1 has an exhaust pipe 2 which is surrounded by a water jacket 2*a* so that the pipe 2 is cooled by cooling water circulating in the jacket 2*a*. The water jacket 2*a* is connected with water jackets (not shown) provided in the engine body 1*a* for cooling the engine cylinders. A cooling water pipe 23 is provided for drawing water from the water passage 20 to the water jacket in the engine body 1*a* whereby the cooling water is circulated through this water jacket to the water jacket 2*a* on the exhaust pipe 2.

The exhaust pipe 2 is connected with an expansion chamber assembly 3 which comprises a first pipe section 3*a* and a second pipe section 3*b* which are connected together by means of a resilient connector 6. The first pipe section 3*a* is connected to the exhaust pipe 2 and the second pipe section 3*b* is connected with a silencer 4. The second pipe section 3*b* is supported on the engine body 1*a* through a resilient pad 7 which is interposed between a bracket 8 on the body 1*a* and a fitting 11 on the pipe section 3*b*. The silencer 4 is opened to a discharge chamber 5 which is provided with a discharge pipe 13 as taught by Japanese utility model publication Sho No. 52-18551 published on Apr. 26, 1977. The water jacket 2*a* is connected through a pipe 12 with the first pipe section 3*a* of the expansion chamber assembly 3 so that the cooling water in the jacket 2*a* is discharged into the expansion chamber assembly 3 to be exhausted with the combustion gas.

Figure 2:
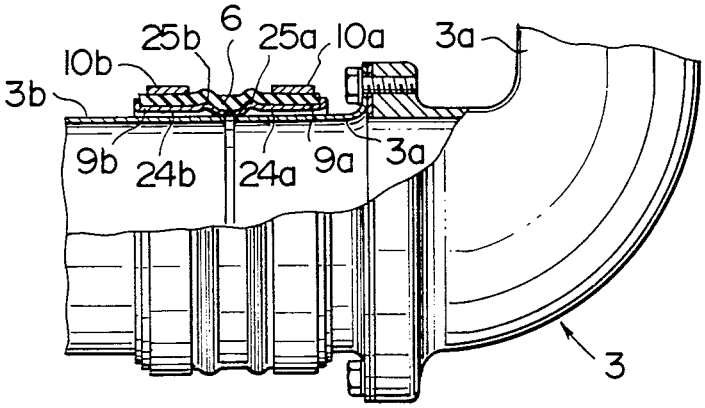
FIG. 2 is a fragmentary side view specifically showing the resilient connection between two butted exhaust pipe sections.
Figure 3:
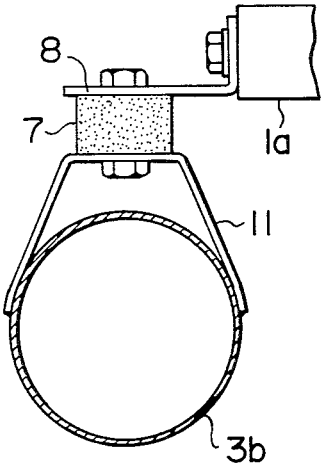
FIG. 3 is a cross-sectional view showing the resilient mounting of the exhaust pipe.

Referring specifically to FIG. 2 which shows the connection between the pipe sections 3*a* and 3*b*, the first pipe section 3*a* has a sheath 9*a* secured at one end to the pipe section 3*a* by suitable means such as welding. Similarly, the second pipe section 3*b* has a sheath 9*b* welded to the pipe section 3*b*. As shown in FIG. 2, the sheaths 9*a* and 9*b* have annular gaps 24*a* and 24*b* with respect to the pipe sections 3*a* and 3*b* and formed with beads 25*a* and 25*b* at appropriate portions thereon.

The resilient connector 6 is in the form of a tube and fitted to the sheaths 9*a* and 9*b*. Clamps 10*a* and 10*b* are used to gas-tightly securing the connection 6 to the sheaths 9*a* and 9*b*. Since the connection between the pipe sections 3*a* and 3*b* has an adequate resiliency, any vibration from the engine is absorbed. Further, since the second pipe section 3*b* is supported by the engine body 1 through the resilient pad 7, it is possible to decrease the transmittal of engine vibration to the second pipe section 3*b* to a substantial extent. It should further be noted that the air gaps 24*a* and 24*b* between the pipe sections 3*a* and 3*b* and the sheaths 9*a* and 9*b* provide thermal insulation. Thus, it is possible to decrease heat transfer from the pipe sections 3*a* and 3*b* to the resilient connector 6. The illustrated arrangement is therefore effective to ensure an extended life of the resilient connector 6.

Figure 4:
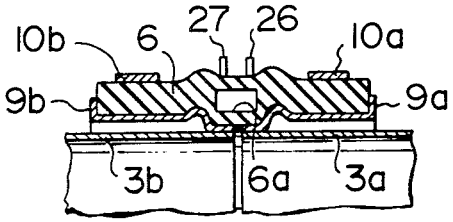
FIG. 4 is a fragmentary sectional view showing another embodiment of the present invention.

Referring to the embodiment shown in FIG. 4, the resilient connector 6 has the same configuration as in the previous embodiment and further is formed with an annular water passage 6*a* having a water inlet 26 and a water outlet 27. The water inlet 26 may be connected with the water jacket 2*a* in the previous embodiment so that cooling water is supplied from the water jacket 2*a* to the water passage 6*a*. Further, the outlet 27 may be opened to the pipe section 3*b* so that the cooling water is discharged into the engine exhaust system to be exhausted together with the engine combustion gas. This arrangement is also effective to prevent thermal deterioration of the connector 6.

The invention has thus been shown and described with reference to specific embodiments, however, it should be noted that the invention is in no way limited to the details of the illustrated structures but changes and modifications may be made without departing from the scope of the appended claims.

We claim:

1. Motor-propelled boat comprising a boat hull, internal combustion engine means mounted on said boat hull through resilient mounting means and adapted to drive propulsion means, said engine means including body means, exhaust means connected with said body means, and cooling water jacket means formed in said body means for passing cooling water therethrough, said exhaust means including first pipe means rigidly connected with the body means and second pipe means connected with the first pipe means through resilient connecting means, said cooling water jacket means having outlet means, connected with the first pipe means so that the cooling water which has passed through the jacket means is discharged into the first pipe means, said second pipe means being further supported through resilient support means by said body means of the engine means.

2. Motor-propelled boat in accordance with claim 1 in which said first and second pipe means respectively have first and second sheath means which are rigidly connected with said respective pipe means, said resilient connecting means including resilient tubular member means fitted to the sheath means.

3. Motor-propelled boat in accordance with claim 2 in which said first and second sheath means are radially spaced apart from the first and second pipe means through substantial parts of their lengths so as to provide thermally insulative air gaps with respect to the first and second pipe means.

4. Motor-propelled boat in accordance with claim 2 in which said resilient tubular member means is formed with cooling water passage means.

5. Motor-propelled boat in accordance with claim 4 in which said cooling water passage means is connected with the cooling water jacket means for the engine.

6. A motor-propelled boat comprising a boat hull, internal combustion engine means mounted on said boat hull through resilient mounting means and adapted to drive propulsion means, said engine means including engine body means and exhaust means connected with said engine body means, and cooling water jacket means formed in said engine body means for passing cooling water therethrough, said exhaust means including first and second pipe means, said first pipe means being rigidly connected with said engine body means, said second pipe means being connected with said first pipe means through first resilient connecting means and with said engine body means through second resilient support means, said cooling water jacket means having outlet means connected with said first pipe means so that the cooling water which has passed through the jacket means is discharged into said first pipe means, said first and second pipe means having first and second sheath means, respectively, which are rigidly connected with said first and second pipe means, respectively, so that said first and second sheath means are radially spaced apart from said first and second pipe means, respectively, through substantial parts of their lengths so as to provide thermally insulative air gaps with respect to said first and second pipe means, said first resilient connecting means including resilient tubular means fitted to said sheath means, said tubular means including an interior, annular cooling water passage means.

7. The boat of claim 6 wherein said annular cooling water passage means is connected with said cooling water jacket means.

* * * * *